US005511326A

United States Patent [19]

Liebrecht, Jr.

[11] Patent Number: 5,511,326

[45] Date of Patent: Apr. 30, 1996

[54] ROTATING DISK-TYPE DITCHER

[76] Inventor: Sylvester J. Liebrecht, Jr., Rte. #2, 17771, Continental, Ohio 45831

[21] Appl. No.: 240,115

[22] Filed: May 9, 1994

[51] Int. Cl.[6] ..... E02F 5/08

[52] U.S. Cl. ..... 37/93; 37/347; 37/907

[58] Field of Search ..... 37/907, 91–93, 37/189; 172/108, 113; 299/39; 404/90

[56] References Cited

U.S. PATENT DOCUMENTS

| | | | |
|---|---|---|---|
| 2,746,180 | 5/1956 | Ficker | 37/92 |
| 2,974,735 | 3/1961 | Smith et al. | 37/92 |
| 3,041,750 | 7/1962 | Garnard | 172/113 |
| 3,261,117 | 7/1966 | Shoemaker et al. | 37/92 |
| 3,411,225 | 11/1968 | Barras | 37/93 |
| 3,417,495 | 12/1968 | Barras | 37/93 |
| 3,708,232 | 1/1973 | Walsh | 356/172 |
| 3,813,171 | 5/1974 | Teach et al. | 356/152 |
| 3,916,543 | 11/1975 | Poche | 37/93 |
| 3,994,083 | 11/1976 | Cunningham | 37/80 R |
| 4,161,072 | 7/1979 | Pronovost | 37/93 |
| 4,162,708 | 7/1979 | Johnson | 172/4.5 |
| 4,193,217 | 3/1980 | Poche | 37/93 |
| 4,454,767 | 7/1984 | Cartner | 37/81 |
| 4,887,372 | 12/1989 | Block . | |
| 4,912,643 | 3/1990 | Beirxe | 364/449 |
| 5,113,610 | 5/1992 | Liebrecht | 37/94 |
| 5,174,385 | 12/1992 | Shinbo et al. | 37/907 |
| 5,259,692 | 11/1993 | Beller et al. | 404/90 |

FOREIGN PATENT DOCUMENTS

| | | | |
|---|---|---|---|
| 310978 | 8/1971 | U.S.S.R. | 37/93 |
| 487986 | 10/1975 | U.S.S.R. | 37/93 |

OTHER PUBLICATIONS

Publication Agricultural Engineering, Aug. '71, pp. 418, 419.

"The laserplane System" by David C. Studebaker.

*Primary Examiner*—Spencer K. Warnick, IV

*Attorney, Agent, or Firm*—Charles F. Schroeder

[57] ABSTRACT

A method and apparatus in which a disk-type ditcher adaptable to being drawn by a tractor can dig ditches under control of a laser system by which a desired ditch grade can be selected. The ditcher incorporates a disk rotatable in a generally vertical plane transverse to the line of travel of the ditcher, the disk having circumferentially spaced scoops which during rotation function in cooperation with a bottom-cutting blade and soil plowing section to lift the cut soil for discharge from an angularly oriented overlying chute for directing soil particles a pre-selected lateral distance from the line of travel of the tractor. A pair of forwardly and oppositely positioned angularly adjustable side cutting or scraping blades can be provided in spaced relation on opposite sides of the center line of travel to impart steeper side walls to the ditch than would otherwise be formed with the circular disk alone.

19 Claims, 4 Drawing Sheets

ROTATING DISK-TYPE DITCHER

FIELD OF THE INVENTION

The present invention is a method and apparatus herein described and exemplified by a rotating disk ditch forming machine or "ditcher" adaptable to being drawn by a tractor. Whereas in my previously patented disk-type ditcher of U.S. Pat. No. 5,113,610 issued on May 19, 1992, the disk was inclined downwardly toward the rear of the line of travel of the ditcher for soil cutting action, the disk of the ditcher of the present invention rotates in a generally vertical plane extending generally transversely to its line of travel in forming a ditch. Also in contrast to my previous ditcher in which the disk provided the principal cutting action, the present ditcher has a bottom cutter edge which cuts into soil in advance of the rotating disk and supplies loosened soil to the bottom of the disk. The soil particles are then lifted by moving circumferentially spaced scoops or buckets on the disk to be thrown through an overlying angularly adjustable chute for deposition of the particles a preselected distance laterally of the line of travel of the ditcher.

The ditcher can also incorporate a pair of angularly adjustable side sloping blades positioned slightly above the bottom cutting edge and on both sides of the line of travel of the ditcher to cut a ditch with steeper more straight sidewalls rather than curved sides which would otherwise result without such side sloping blades. The side sloping blades are each angularly oriented individually toward the center of the line of travel to guide or, in a sense, funnel side cut soil particles into a lower shroud for collection and removal by the rotating disk bucket scoops.

The ditcher of the invention is particularly adaptable to being regulated in the height of its cutting action by a conventional laser beam system to establish a preselected grade in forming drainage ditches extending over considerable length. In this regard, a laser beam of commercial type having grade selection capabilities is rotated over an area through which a ditch is to be cut to provide a reference plane defined by the rotating beam inclined at a selected grade. Such an arrangement is described in an article entitled "The Laser Plane System" published in "Agricultural Engineering", August, 1971, pages 418 and 19. The ditcher of the present invention lends itself admirably to continuous adjustment of its cutting height automatically by controls which cause it to cut each increment of length of the ditch being formed according to the grade selected.

In this regard a laser beam sensor is provided on the ditcher which provides signals for regulation of hydraulic controls such as on the tractor, to make continual adjustments in the force exerted by the tractor hydraulics on the cutter height fixing mechanism. An adjustment for the depth of cut necessary for the desired grade is thus made at each increment of travel of the ditcher through the area in which the ditch path is being formed regardless of terrain changes encountered. The laser beam, for example, may be rotated at 600 rpm and thus send 10 pulses per second to the receiver on the ditcher to make an adjustment according to such pulse signals for each increment of movement of the ditcher through an area.

The extent of the depth of cut of the ditcher for each pass through the area is selected by the operator as determined by on-site trial of soil conditions. The final depth of the drainage path desired determines the number of passes necessary for the ditcher to form the ditch of desired depth. If a wider ditch is desired than is cut in a single pass, side-by-side passes are made, as well as passes over each other, to establish the width and depth desired in the final drainage path.

SUMMARY OF THE INVENTION

The soil removing disk of the ditcher is rotated within a generally vertical plane which is generally transverse to the line of travel of the ditcher as it makes a pass through soil at a selected depth. In making the pass, soil is cut by a bottom cutting blade which underlies the disk and projects forward from the generally circular disk housing or shroud assembly to cut and loosen soil which is scooped up by the rotating disk. The cutting blade is arcuately shaped extending upwardly on both sides of the line of travel to a position approximately 45 degrees up from the bottom.

As the ditcher with its leading cutting blade advances the soil cut thereby is loosened and pushed into the bottom of the shroud, or in a single word is plowed, into the path of the scoops on the rotating disk. The scoops or buckets collect the plowed soil from the bottom of the lower shroud and moves it laterally and upwardly through a confined arcuate path defined by the inner periphery of the open faced lower shroud and a matching closed upper shroud to a discharge opening to an overlying laterally oriented discharge chute. The soil particles are ejected laterally from the scoops through the discharge chute under the force of rotation imparted by the disk and are thrown a distance dependant upon the speed of rotation of the disk. The collected soil is retained in the buckets from the bottom of the ditcher in the confined path formed with the circular inner periphery of the lower and upper shrouds until the soil particles reach the discharge chute opening in the side of the upper shroud. The soil is thereupon thrown through the opening in a tangential line of travel guarded by the overlying chute through which it travels for deposition laterally in a location determined in part by the angle of the chute.

The cutting action of the ditcher is adjustable as needed during its travel through an area in which a ditch is to be formed to cut the grade of ditch pre-selected at the laser controls. Once the grade is selected at the laser unit the laser beam is rotated in a corresponding angularly oriented reference plane extending over the area in which the ditch is to be formed. The hydraulic actuating sensor at the ditcher is arranged to follow the level of the reference plane as the ditcher moves along the path in which the ditch is to be cut. The cutting blade and disk are thereby raised and lowered incrementally as needed to cut the ditch path to the grade selected. A ditch can be cut in a single pass but if a greater depth is desired, a series of passes can be made consecutively in the same path until the desired depth is attained. If a wider ditch is desired more than one pass side-by-side can be made for the width desired.

An object of the invention is to provide a ditcher which is readily and accurately adjustable in its depth of cut for a desired grade.

A further object of the invention is to provide a ditcher capable of adjustably tossing and distributing soil a considerable distance to the side of the path of drainage being formed.

Another object of the invention is to provide an efficiently operable ditcher adaptable to being drawn by conventional tractors.

Still another object of the invention is to provide a ditcher which is readily controllable automatically to cut a ditch to a preselectable desired grade.

A feature of the invention is the ready adjustability of the depth of cut and close control of the depth of cut as the ditcher moves over an area in which a ditch is to be formed.

Another feature of the invention is that although the ditch is formed with a rotating disk, the ditch profile can be arranged to have a selected side wall slope of any of a number of slopes which trials indicate will result in a minimum amount of soil erosion.

Other objects and features which are believed to be characteristic of my invention are set forth with particularity in the appended claims. My invention, however, both in organization and manner of construction, together with further objects and features thereof, may be best understood by reference to the following description taken in connection with the accompanying drawings.

DETAILED DESCRIPTION OF THE INVENTION

Figure 1:
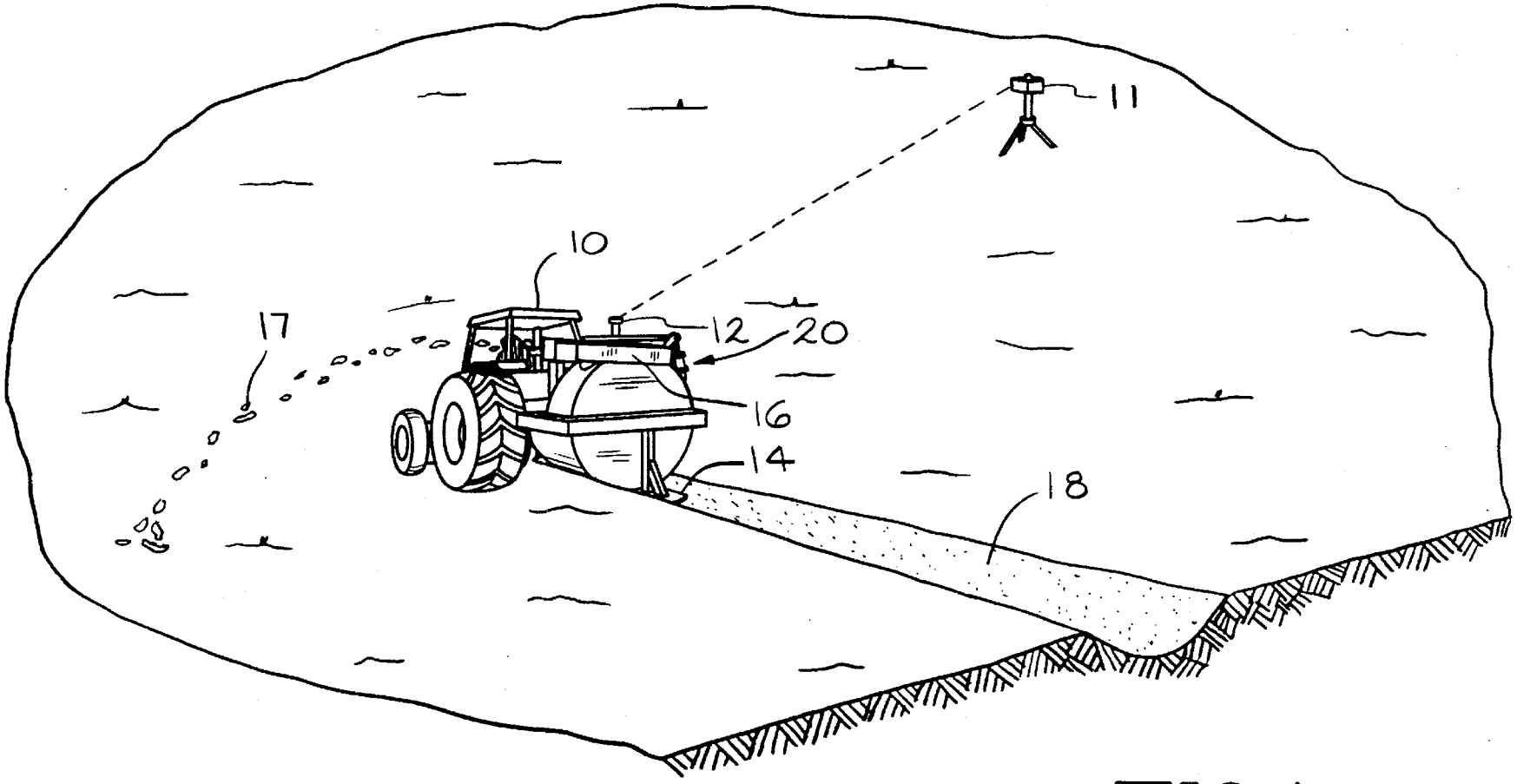
FIG. 1 is a schematic view showing a ditch being cut through an open area by a tractor-drawn ditcher of the present invention in which the depth of cut is regulated by a laser plane transmitter.

Turning to the drawings in greater detail FIG. 1 shows a ditcher 20 of the invention drawn by a tractor 10 to form the first pass of a ditch 18. A rotatable laser transmitter 11 is located in the general area in which the ditch is formed. The laser transmitter rotates a laser beam to in a sense define a plane overlying the ditch area, such plane being adjustably angled according to a grade selected at the transmitter. A laser sensor 12 on the ditcher 20 is arranged to follow the plane of the laser beam to arrange through automatic controls in the tractor to raise and lower the depth of the cut to be made at each increment of length of the ditch to match the grade to which the ditch is to be cut. The depth of cut by the ditcher is adjusted by moving the forward end of the ditcher up and down about a height reference trailing end of a shoe 14 which trails the ditcher as it is drawn through the area being cut. Soil particles 17 cut by the ditcher are lifted upwardly and discharged a distance laterally of the ditcher by being thrown through a discharge chute 16 which is adjustable in angle to permit selection of the direction and lateral distance of throw of the particles 17.

Figure 2:
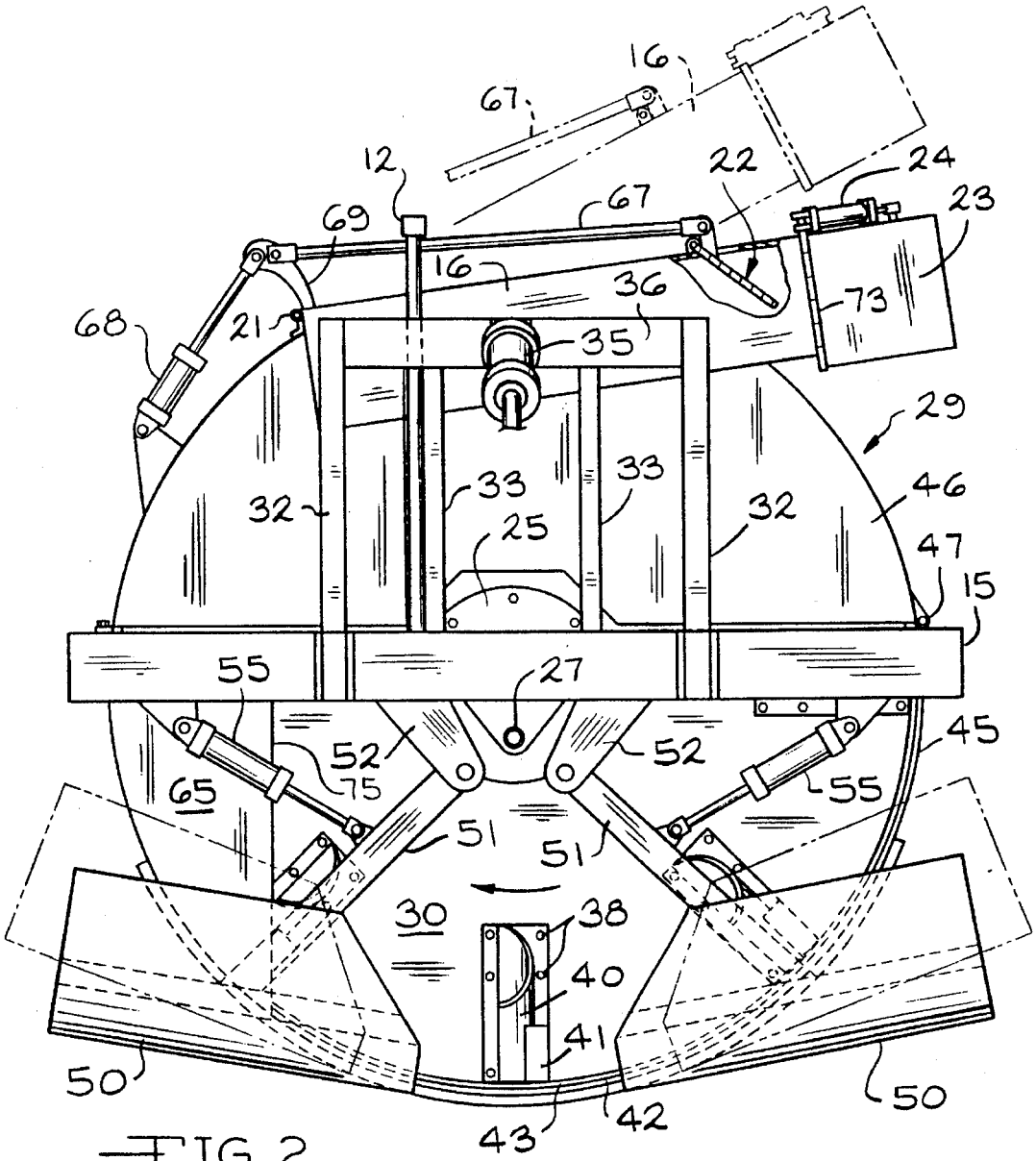
FIG. 2 is a front elevation partially dashed line view of the disk type ditcher assembly of the present invention as it is drawn by a towing tractor.

FIG. 2, which is a frontal view of the ditcher as it appears from the tractor 10, illustrates that the ditcher includes a disk 30 rotationally driven clockwise through a speed reducer 25 supplied with power from the tractor through a take off shaft 27. The disk 30 includes a series of soil buckets or scoops 40 radially aligned and spaced about the periphery at the outer edge of the disk 30. Each of the scoops 40 is secured to the disk by bolts 38 and each is fixed more stably in place by a backup brace 41 illustrated more clearly in FIG. 8.

The disk 30 rotates within a generally circular housing 29 formed by an open lower semicircular shroud 45 and matching closed upper semicircular shroud 46 slightly larger in diameter and matched in mated relation to the circumference of the disk. The upper shroud 46 forms a closure on the front and back sides of the disk but can be opened to replace worn parts by lifting it about a pivot 47 at the right of FIG. 2 to expose the interior of the ditcher as needed such as to replace worn parts. The overall ditcher assembly is supported by a tow bar 15 which as shown in FIG. 3 can be connected to a tractor by way of a connector bar 59 extending between the tow bar tongue 19 and a floating connector 59 on the tractor.

Figure 3:
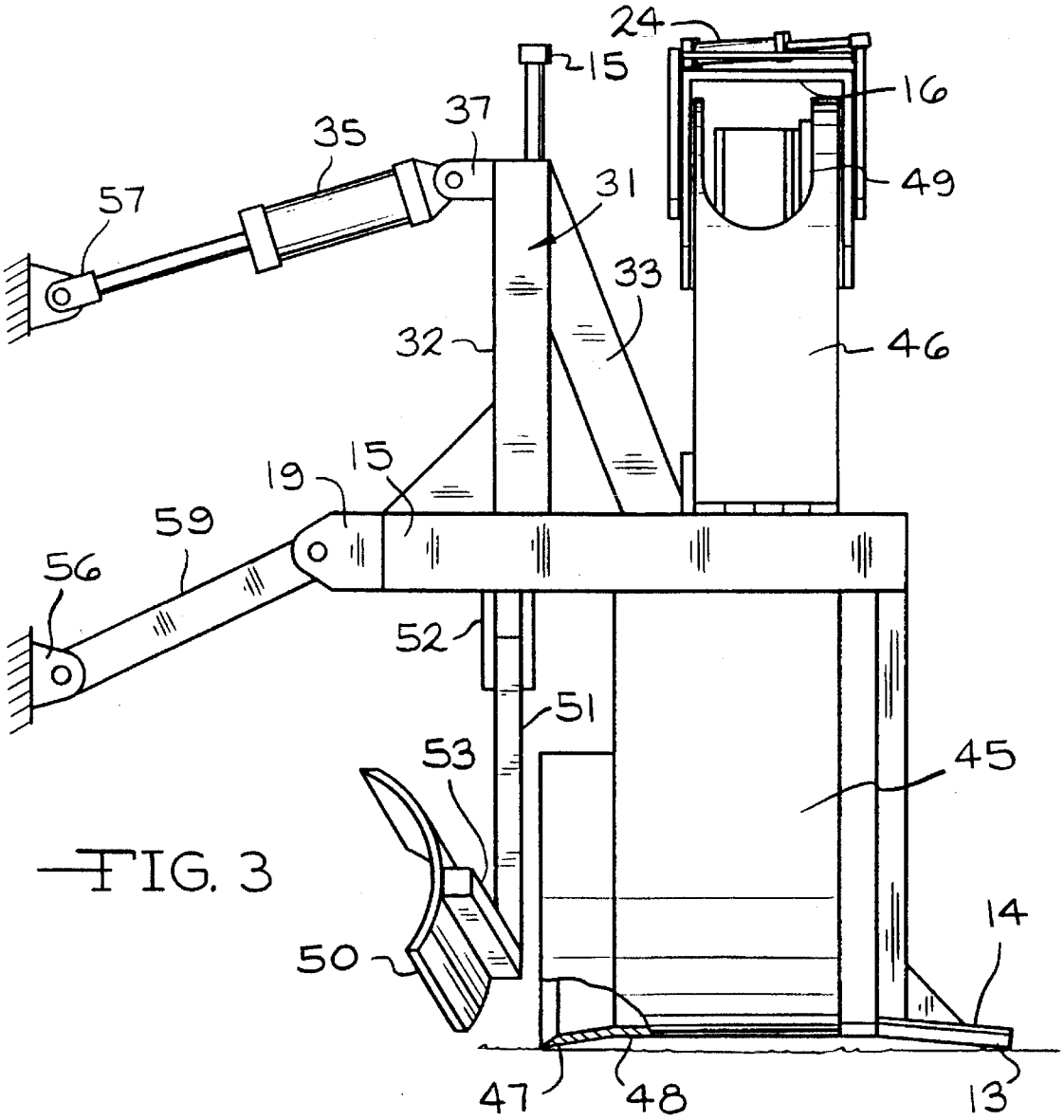
FIG. 3 is a partially broken away side elevation view of the ditcher of FIG. 2.

FIG. 3 shows the side view of the height adjustment frame assembly 31 of the ditcher which includes a pair of spaced apart generally vertical side members 32 and angular bracing members 33 all joined by a cross member 36. [FIG. 2] A soil cutting edge 47 shown in cross section projects forwardly of the lower shroud 45 to cut into new soil of the ditch being formed. The cutting edge 47 is part of the plow portion 48 of the bottom of the shroud 45 which in turn is part of the circular housing having a diameter slightly larger than the diameter of the disk. Upon cutting into new soil, the cutting edge and plow portion 48 lifts the soil slightly upwardly and causes it to be shoved toward the disk 30. This plowing and shoving action results in the soil breaking up into smaller pieces or particles as it is fed to the bottom of the disk 30. The scoops 40 on the rotating disk thereupon sweep across the circumferential bottom of the shroud to lift the soil particles up through the closed upper shroud 46 to the top of the ditcher for discharge through an overlying chute 16.

The level of the cutting edge 47 is determined by the angle to which the ditcher is set in relation to its reference trailing edge 13 of the shoe 14. The trailing edge 13 of the shoe 14 is drawn over the level of the ditch portion formed by the cutter 47 while the leading edge of the shoe is angled upwardly to clear the bottom of the ditch being formed. The level of the cutting edge 47 projecting forward of the shroud 45 is determined by the position established by the hydraulic cylinder and piston assembly 35 connected between a connection 57 to the tractor 10 and the cross member 36 (FIG. 2) by way of a connecting tongue 37 projecting from the adjustment frame 31.

The piston of the hydraulic assembly 35 in pushing the height adjustment frame 31 lifts the cutter edge 47 in relation to the trailing edge 13 of the guide shoe 14 thereby making the cut shallower than a preceding incrementally cut portion of the ditch. Upon retraction of the piston of the hydraulic cylinder assembly 35, the cut of the ditcher is caused to go deeper into the soil in relation to the guide shoe 14. Thus the depth of cut by the cutting edge 47 is determined by the position of the piston in the cylinder assembly 35 which in turn can be set either manually at the tractor hydraulic controls or automatically during each increment of travel of the ditcher by the laser beam sensor 15. The laser sensor 15 sends a signal to the hydraulic unit in the tractor which supplies the power to the piston assembly 35 to establish the position of the height adjustment frame assembly 31 in relation to the trailing edge 13 of the height reference guide shoe 14.

During cutting operations, a major portion of the bottom of the lower shroud 45 rides above its cutting edge 47 and the trailing edge of the stabilizing guide shoe 14. The guide shoe 14 is made of hardened steel which will withstand the forces of support of the ditcher and the wearing rigors of being drawn through newly cut soil.

Figure 7:
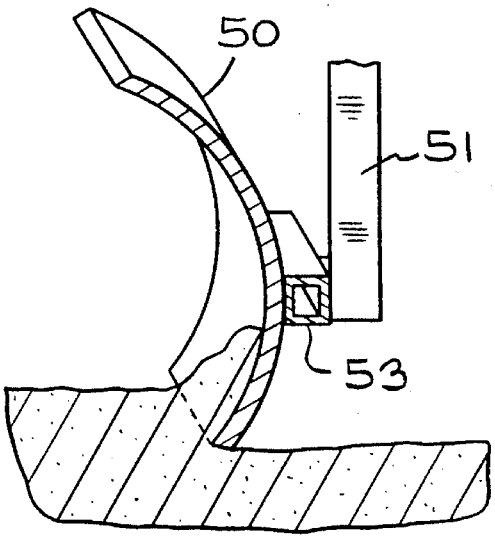
FIG. 7 is an enlarged cross-sectional view of a portion of the ditcher of FIG. 3 illustrating a side cutting clearing blade of the assembly.

In addition to the cutting a pass for a ditch with the cutting edge 47 a pair of side sloping blades 50 are provided angularly positioned on opposite sides of the center of the line of travel to cut into the side walls of the ditch pass at a shallower depth in advance of the cutting edge 47. The side sloping blades impart steeper side walls to the profile of the ditch being cut than is otherwise formed by the bottom cutting blade 14 alone. The side blades 50 are each adjustable in their height and angular orientation as illustrated in dashed lines. [FIG. 2] In such position the inner bottom corner edge of the side blades acts somewhat as a wedge in removing side wall soil ahead of the cutting edge 47. Each is adjusted by its own cylinder and piston assembly 55 connected between the tow bar frame 15 and a blade support arm 51 pivotally connected to a pivot support 52 mounted on the tow bar frame 15. The side sloping blades are curved to facilitate gathering of soil. They are angled inwardly as shown in FIG. 3 from their outer extremes toward the center of the bottom shroud 45 to, in a sense, push the soil cut and collected by them into the center bottom-most portion of the shroud 45 and toward the circumferential region of travel of the scoops 40 through the bottom shroud 45. FIG. 7 is an enlarged detailed illustration of a curved side sloping blade 50 showing how it is mounted on its blade support arm 51 by way of a cross bar 53 extending across its back surface.

Figure 8:
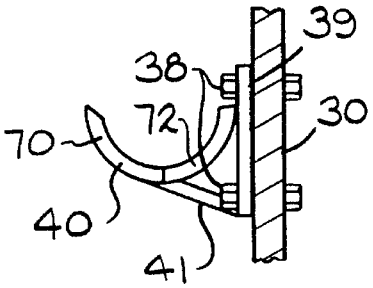
FIG. 8 is an enlarged cross-sectional view of a scoop mounted on the disk of the ditcher of FIG. 3.

FIG. 8 illustrates in enlarged greater detail the manner in which each of the scoops 40 is mounted on the disk 30 by way of a back plate 39 secured by bolts 38 extending into the disk 30 and the manner in which the scoop is strengthened in its mounting position by a brace 41 extending between the bottom of the back plate 39 and the mid-region of the bottom of the scoop.

Figure 4:
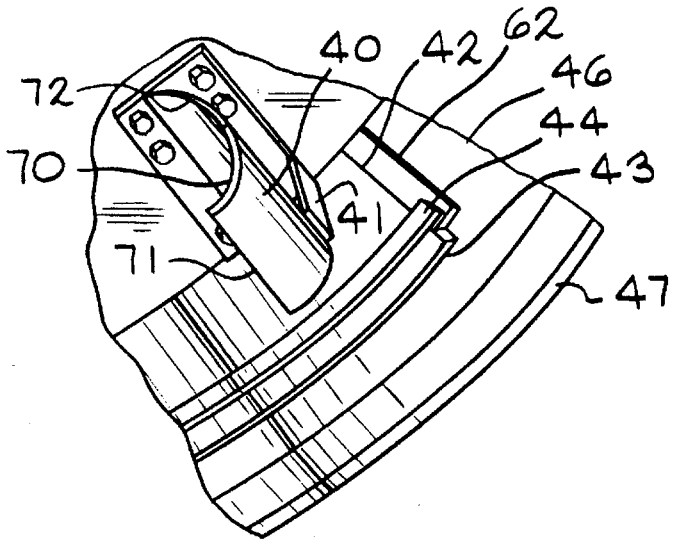
FIG. 4 is a perspective view of a portion of the interior of the ditcher of FIG. 3 showing a portion of the cutting blade and the wear band associated with the soil scoops.

FIG. 4 also illustrates in detail how the scoops 40 are mounted on the disk 30 and illustrates further as may also be seen in FIG. 2 that the top edge 72 of each has a slanted edge portion extending therefrom at an angle from about the middle of the backside of the scoop to a point at its outer edge 71 to form an angular edge portion 70 selected between 30 and 60 degrees to the open end top edge 72 of the scoop dependant upon trials in soil of the type in which a ditch is to be cut. It has been found that such an angular edge 70 facilitates rejection of large solid clumps of soil or stones. Further in this regard a stone deflector plate 65 shown in FIG. 2 is provided which closes the clockwise trailing portion of the lower shroud 45. The deflector plate is provided with a vertical edge 75 and is arranged to close approximately 15 to 25% of the trailing face portion of the lower shroud. It has been found that the deflector plate also assists in rejecting large solid clumps and stones as the scoops sweep through their path in lifting soil from the bottom shroud 45 of the ditcher up through the upper shroud 46 and out. The slanted edges 70 of the scoops and the vertical edge 75 of the deflector plate 65 cooperate in ejection of clumps and stones before they can be conveyed up into the upper part of the lower shroud 45 and into the upper shroud 46.

FIG. 4 illustrates further how the wear band 42 is held in place by an end plate 62 secured to the bottom of the shroud 46 such as by welding. The end plate is provided with an under cutting wedge surface against which the mating slanted end of the wear band 42 is wedged. By pressing the end of the wear band into mated communication with the slanted edge of the end plate 62 the end of the band 42 is held securely in place.

Figure 5:
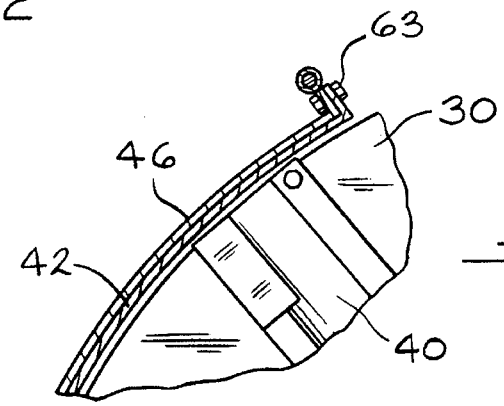
FIG. 5 is a cross sectional view of the securing mechanism by which one end of the wear band associated with the soil scoops is solidly held in place.

The opposite end of the wear band 42 is secured against the inner periphery of both the lower and the upper shrouds by bolts 63 extending through a bent up lip of the shroud 46 as shown in FIG. 5. The wear band 42 made of hardened steel provides the surface across which the open end of the scoops 40 move soil collected therein. Soil is moved across the wear band during all soil removal operations of the ditcher and accordingly the band requires occasional removal and replacement when it becomes too worn. To effect such replacement, the upper shroud is unfastened at bolts diametrically opposite to the pivot 47 and the shroud is then lifted and pivoted about the pivot 47. This disengages the band from its wedged relation with the end plate 62. The band is then disconnected at its securing bolts 63 and replaced with a new band.

Figure 6:
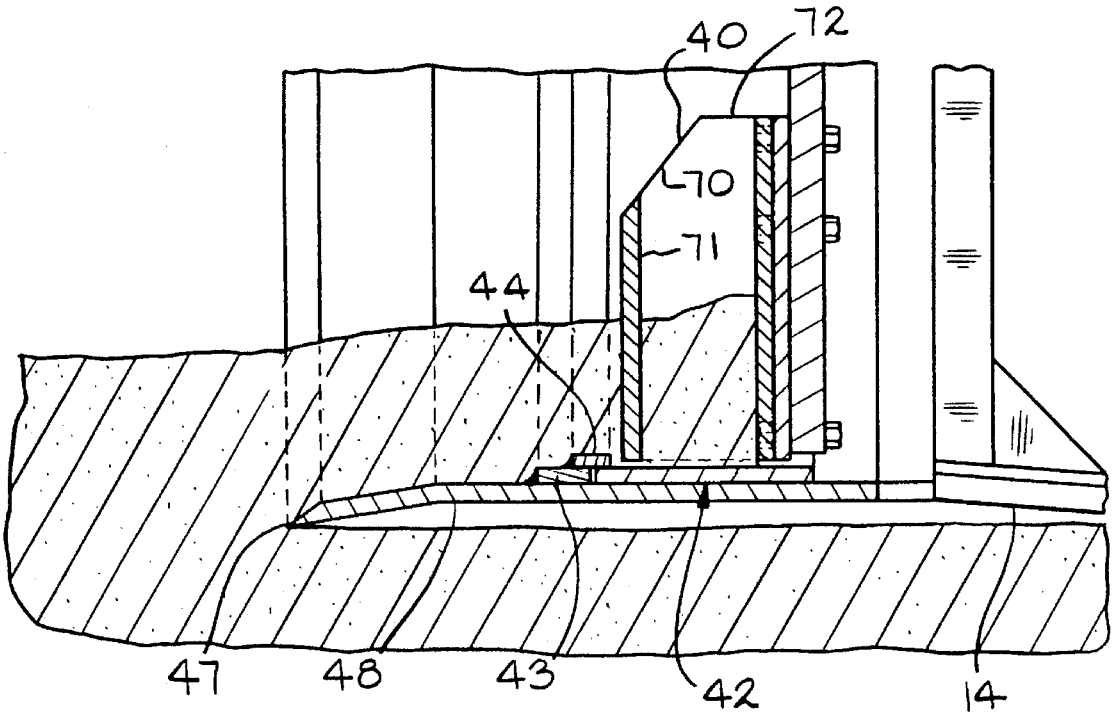
FIG. 6 is an enlarged cross-sectional view of a portion of the ditcher of FIG. 3 illustrating the bottom cutting blade and plow section of the assembly.

FIG. 6 illustrates more clearly how soil is cut by the cutting edge 47 at the forward extending plow portion 48 of the bottom shroud 45. The wear band 42 provides a confining mating surface for the outer extremities of the scoops 40. The soil particles are thereby prevented from being freely released from the scoops between the region of pickup below. A guard band 43 is provided in collinear abutting relation with and in advance of the wear band 42. An overlying mating strip 44 bridging the abutting guard band and wear band prevents the soil particles from falling between the two bands.

In operation of the ditcher, soil which is cut and plowed up is directed toward the region of rotation of the scoops 40. The scoops pick up the soil and moves it circumferentially about the interior periphery of both the open lower shroud 45 and the closed upper shroud 46, respectively, for discharge through an opening 49 where the soil is released into a tangentially oriented overlying chute 16 through which it is projected by the momentum imparted by the moving scoops. The soil is passed through the length of the chute 16 to an end region where a spreader plate 22 can spread the soil particles widthwise prior to being directed selectably forward or rearwardly by a pair of side-by-side spaced adjustable lateral director plates 23. The director plates 23 are positionable in unison by an adjusting cylinder piston assembly 24 to determine the final direction of release of the particles discharged from the ditcher.

The discharge chute 16 is an inverted "U" shaped channel which extends in straddled relation over the top of the upper shroud 46 with its sides overhanging the shroud. A pivot 21 is provided at one end about which the chute can be lifted to any of a range of angles including an angle as illustrated in dashed lines in FIG. 2. The chute is lifted by a hydraulic cylinder and piston assembly 68 mounted to one side of the upper shroud 46. The piston rod of the assembly 68 is connected to a rocker arm 69 to which a chute connecting rod 67 is joined for connection to the top of the chute by way of the spreader plate 22. The chute can be raised and lowered in its angular position by operation of the cylinder and piston assembly 68 by hydraulics controlled from the tractor.

The spreader plate 22 can be raised, for example, to within 10 degrees of the upper interior surface of the lowered chute whereupon the cylinder assembly 63 will begin to lift the angle of the chute. Soil discharged from the lowered chute will be fanned out horizontally by the spreader plate at the same time directing the soil downwardly at an angle closer to the side of the ditcher. Lifting the spreader plate allows discharged soil particles to be projected further laterally. The soil particles being discharged can be additionally directed forward or to the rear of the ditcher movement by the director plates 23 each of which can be angularly oriented about a hinge 73 connecting the respective plates to the end of the chute 16. Thus by control of the angle of the chute 16 the position of the spreader plate 22 and the angular orientation of the director plates 23 a range of controls for directing the soil particles from the chute is possible so that the soil can be deposited laterally in any of a number of desired locations.

By way of example of specifications for a ditcher of the invention, the disk can have a diameter of 6 feet for operation by a tractor having a power rating of 120–130 horsepower. The tractor take off shaft operating at a speed of 1000 RPM into a 7 to 1 speed reducer will drive the disk at 142–143 RPM. As an example each of the eight radially mounted scoops 40 can have dimensions of length 18", width 7½", and depth 3¾". In cutting a pass to a depth of two feet in soil of general character the speed of formation is about 20 feet/minute or 1200 feet/hour. A ditch 6 feet in depth and 8–9 feet wide or wider can be formed by successive passes over each other. With a 300 horsepower tractor, a ditcher can be drawn having a disk 8 feet in diameter, capable of digging a deeper ditch.

The ditcher described herein, although disclosed as an attachment mechanism to be drawn by a tractor, it will be understood by those versed in the art that the assembly can be provided with its own drive power, controls and adjustment capabilities to permit its self-propelled operation independently of a tractor. Still further, it will be recognized that the cutting edge 47 and the plow portion 48 behind it rather than being limited to a circular shape may be shaped somewhat rectangularly at the cutting edge and tapered inwardly in the plow portion 48 leading to the circular shape at the region of the wear band 42. The shape of a pass in forming a ditch cut by such a leading cutting edge is thereby correspondingly made more rectangular in shape.

In view of the foregoing that a number of variations of the arrangement of my invention can be provided within a broad scope of principles embodied therein. Thus while a particular preferred embodiment of my invention has been shown and described herein, it is intended by the appended claims to cover all such modifications which fall within the true spirit and scope of the invention.

I claim:

1. A ditcher assembly for forming longitudinal ditches through soil in a given area comprising a prime mover for moving said assembly in a line of travel corresponding to the line of the longitudinal ditch desired, a rotary soil removing disk mounted in said assembly, said disk having a generally vertical planar orientation generally transverse to said line of travel, a housing within which said disk is rotated comprising a lower shroud and an upper shroud mated therewith, power supply means for rotationally driving said soil removing disk, said disk having a front face facing the direction of travel of said assembly, said disk comprising a series of soil gathering scoops spaced about the circumferential edge of said front face, a lower front portion of said lower shroud facing the direction of travel of said assembly being open to expose the lower portion of said rotary disk, a soil cutting edge and plow section positioned centrally in said line of travel at the bottom of said open lower shroud for cutting in advance of said rotary disk by which soil being cut is fed in loosened condition to the path of movement of said scoops, means for selectively setting the cutting depth of said cutting edge and plow section, an adjustably orientable chute means overlying said disk for receipt of soil conveyed and discharged from said scoops for directing the cut soil to preselectable locations relative to the line of travel of said assembly, and a pair of vertically adjustable side sloping blades positioned to cut a selectable steepness in the sidewalls of ditch passes being formed.

2. A ditcher assembly as set forth in claim 1 wherein said means for setting the cutting depth of said cutting edge and plow section comprises a reference member positioned to trail behind said ditcher and means for lifting the forward portion of said ditcher relative to said trailing reference member.

3. A ditcher assembly as set forth in claim 1 wherein a replaceable wear surface of wear resistant material is provided adjacent and about the soil conveying path of movement of said scoops through said ditcher.

4. A ditcher assembly as set forth in claim 3 wherein said scoops are each longitudinal members mounted in radially oriented relation at the circumferential edge of said disk, said scoops each being shaped with a concavity facing the direction of rotational movement on said disk, said scoops each having an open top end and an opposite bottom end each of said scoops having its bottom end arranged to be substantially closed by said wear surface as it conveys soil through said ditcher.

5. A ditcher assembly as set forth in claim 1 in which said prime mover is a tractor on the rear of which said ditcher assembly is connected and to which a mechanical driving connection is provided as said power supply means for rotationally driving said soil removing disk.

6. A ditcher assembly as set forth in claim 5 in which the cutting depth of said cutting edge and plow section is adjustably and selectively set with controls on said tractor.

7. A ditcher assembly as set forth in claim 6 in which adjustments in the depth of cut by said cutting edge and plow section is accomplished by remotely controllable hydraulic means.

8. A ditcher assembly as set forth in claim 7 in which rotating laser plane controls with grade selection means is provided with a receiver on said ditcher assembly in interconnected relation with said hydraulic means whereby adjustments in the depth of cut by said cutting edge and plow section are made progressively according to a preselected grade as said ditcher travels over soil in which a ditch pass is being formed.

9. A ditcher assembly for forming longitudinal ditches through soil in a given area comprising a prime mover for moving said assembly in a line of travel corresponding to the end of the longitudinal ditch desired, a rotary soil removing disk mounted in said assembly, said disk having a generally vertical planar orientation generally transverse to said line of travel, a housing within which said disk is rotated comprising a lower shroud and an upper shroud mated therewith, power supply means for rotationally driving said soil removing disk, said disk comprising a series of soil gathering scoops spaced about the circumferential edge of said front face, a lower front portion said lower shroud being open to expose a lower portion of said rotary disk, a soil cutting edge and plow section at the lower leading edge of said lower shroud provided in advance of said rotary disk by which soil being cut is fed in loosened condition to the path of movement of said scoops, means for selectively setting the cutting depth of said cutting edge and plow section, and an adjustably orientable chute means overlying said disk for receipt of soil centrifugally lifted and discharged from said scoops for directing the cut soil to preselectable locations relative to the line of travel of said assembly, and a replaceable wear surface of wear resistant material provided adjacent and about the soil conveying path of movement of said scoops through said ditcher, said scoops each being longitudinal members mounted in radially oriented relation at the circumferential edge of said disk, said scoops each having a concavity in the soil lifting direction of movement on said disk and having an open top end arranged to be substantially closed by said wear surface as it conveys soil through said ditcher, said longitudinal scoops each having a back and each being provided with a slanted outside edge extending generally from the upper center of said back to a point at said outside edge at least one-third of the distance of the length of the scoop down from its top edge to assist in rejecting clumps and rocks in the path of movement of said scoops.

10. A ditcher assembly for forming longitudinal ditches through soil in a given area comprising a prime mover for moving said assembly in a line of travel corresponding to the line of the longitudinal ditch desired, a rotary soil removing disk mounted in said assembly, said disk having a generally vertical planar orientation generally transverse to said lids of travel, a housing within which said disk is rotated comprising a lower shroud end an upper shroud mated therewith, power supply means for rotationally driving said soil removing disk, said disk comprising a series of soil gathering spaced about the circumferential edge of said front face, a lower front portion of said lower shroud being open to expose a lower portion of said rotary disk, a soil cutting edge and plow section at the lower leading edge of said lower shroud provided in advance of said rotary disk by which soil being cut is fed in loosened condition to the path of movement of said scoops, means for selectively setting the cutting depth of said cutting edge and plow section, and an adjustably orientable chute means overlying said disk for receipt of soil centrifugally lifted and discharged from said scoops for directing the cut soil preselectable locations relative to the line of travel of said assembly, and a replaceable wear surface of wear resistant material provided adjacent and about the soil conveying path of movement said scoops through said ditcher, said scoops each being longitudinal members mounted in radially oriented relation at the circumferential edge of said disk, said scoops each having a concavity in the soil lifting direction of movement on said disk and having an open top end arranged to be substantially closed by said wear surface as it conveys soil through said ditcher.

an outside edge of each of said scoops having a top edge and a slanted edge portion extending from the center of said top end generally downwardly and outwardly at an angle in a range of 30 to 60 degrees to said top edge of said scoop.

11. A ditcher assembly as set forth in claim 10 in which said open lower shroud is provided with a stone deflector plate having a vertical edge and enclosing 15 to 25% of the trailing side of said front portion of said lower shroud.

12. A ditcher assembly for forming longitudinal ditches through soil in a given area comprising a prime mover for moving said assembly in a line of travel corresponding to the line of the longitudinal ditch desired, a rotary soil removing disk mounted in said assembly, said disk having a generally vertical planar orientation generally transverse to said line of travel, a housing within which said disk is rotated comprising a lower shroud and an upper shroud mated therewith, power supply means for rotationally driving said soil removing disk, said disk having a front face facing the direction of travel of said assembly, said disk comprising a series of soil gathering scoops spaced about the circumferential edge of said front face, a lower front portion of said lower shroud facing the direction of travel of said assembly being open to expose the lower portion of said rotary disk, a plow section in advance of said rotary disk having a cutting edge located at the bottom of said open lower shroud by which soil is cut and fed in loosened condition in the path of movement of said scoops, means for selectively setting the cutting depth of said cutting edge, an adjustably orientable chute overlying said disk and upper shroud for receipt of soil lifted in said scoops, said upper shroud providing a closed path of movement of soil in scoops passing therethrough, said upper shroud having an opening positioned for passage therethrough of soil from said scoops into said chute whereby said discharged soil can be directed through said chute to desired locations of deposit, and a pair vertically adjustable side sloping blades positioned to cut a selectable steepness in the sidewalls of ditch passes formed.

13. A method of forming an elongate soil depression with side walls in a selected area comprising providing a longitudinal plow section with a cutting edge oriented transversely to the elongate depression to be formed, selecting a depth for cutting soil with said cutting edge for said depression, advancing said cutting edge to cut the soil at said selected depth, plowing said cut soil over said cutting edge under the influence of said advancing cutting edge, collecting said plowed soil with a series of open ended scoops by moving said scoops generally transversely to the direction of advancement of said cutting edge, lifting the soil collected with said scoops through a confined arcuate path, releasing said lifted soil from said scoops to an overhanging directing chute under the influence of the force of movement of said soil from said scoops, orienting said chute to deposit the soil from said scoops a preselected distance laterally of the elongate depression being formed, and providing a pair of vertically adjustable side sloping blades positioned to cut a selectable steepness in the sidewalls of ditch passes formed.

14. The method as set forth in claim 13 in which the depth of cut of soil is automatically adjusted at each increment of the length of said depression to establish a predetermined grade as said cutting edge is advanced in forming said depression.

15. The method as set forth in claim 13 wherein the confined path through which said series of open ended scoops are moved is provided by a housing shaped to match the arcuate path through which the open ends of the scoops are moved.

16. The method as set forth in claim 13 wherein the soil exiting from said chute is spread and directed generally downward to establish a short trajectory of throw of the discharged soil for deposit at a preselected lateral distance from said depression.

17. The method of claim 13 wherein the soil discharged from said chute is deflected in a lateral angular direction selected from any of a range of lateral directions within a preset arc extending from a forward direction to a rearward direction of the line of advancement of said cutting edge.

18. The method of claim 13 wherein at least one side wall of the soil depression is additionally cut by a side cutting blade oriented to provide a preselected side slope angle for said depression.

19. The method of claim 13 wherein the opposite side walls of the soil depression are cut by a pair of oppositely oriented side cutting blades to provide preselected slopes to the sides of said depression.

* * * * *